US005177949A

United States Patent [19]

Städele et al.

[11] Patent Number: 5,177,949

[45] Date of Patent: * Jan. 12, 1993

[54] APPARATUS FOR TRANSPORTING BOBBIN TUBES OF A TEXTILE MACHINE

[75] Inventors: Norbert Städele, Göppingen; Martin Maeser, Albershausen, both of Fed. Rep. of Germany

[73] Assignee: Zinser Textilmaschinen GmbH, Ebersbach/Fils, Fed. Rep. of Germany

[ * ] Notice: The portion of the term of this patent subsequent to Apr. 14, 2009 has been disclaimed.

[21] Appl. No.: 799,765

[22] Filed: Nov. 27, 1991

Related U.S. Application Data

[63] Continuation of Ser. No. 532,382, Jun. 4, 1990, abandoned.

[30] Foreign Application Priority Data

Jun. 9, 1989 [DE] Fed. Rep. of Germany ..... 3918876

[51] Int. Cl.[5] ..... D01H 9/00; B65G 23/06

[52] U.S. Cl. ..... 57/281; 57/90; 198/834

[58] Field of Search ..... 57/281, 90; 198/834

[56] References Cited

U.S. PATENT DOCUMENTS

| | | | |
|---|---|---|---|
| 4,072,062 | 2/1978 | Morling et al. | 198/834 X |
| 4,605,121 | 8/1986 | Wahren | 198/465.1 X |
| 4,884,393 | 12/1989 | Hilleby | 198/834 X |
| 4,964,269 | 10/1990 | Dinkelmann | 57/90 X |

FOREIGN PATENT DOCUMENTS

| | | | |
|---|---|---|---|
| 2111306 | 10/1971 | Fed. Rep. of Germany . | |
| 1760689 | 2/1972 | Fed. Rep. of Germany . | |
| 2429104 | 1/1975 | Fed. Rep. of Germany . | |
| 3712027 | 10/1987 | Fed. Rep. of Germany . | |
| 2560655 | 9/1985 | France | 198/834 |
| 1170660 | 11/1969 | United Kingdom . | |

*Primary Examiner*—Daniel P. Stodola
*Assistant Examiner*—William Stryjewski
*Attorney, Agent, or Firm*—Shefte, Pinckney & Sawyer

[57] ABSTRACT

A transport apparatus for transporting tubes of the type onto which yarn is built by a textile machine includes a flexible endless member which travels in guided manner in a fixed guide device with the flexible endless member in a generally vertical orientation. A plurality of movable guide assemblies are connected to the flexible endless member at spaced intervals therealong and are engagable with the fixed guide device for spacing the flexible endless member out of interference from the fixed guide device during movement of the flexible endless member. A tube carrier portion is mounted to each movable guide assembly for supporting tubes during their transport by the flexible endless member. A plurality of cog members having recesses for engaging the movable guide assemblies are operable to guide the flexible endless member along arcuate portions of its travel path.

11 Claims, 3 Drawing Sheets

APPARATUS FOR TRANSPORTING BOBBIN TUBES OF A TEXTILE MACHINE

BACKGROUND OF THE INVENTION

This is a continuation of co-pending application Ser. No. 532,382 filed Jun. 4, 1990, now abandoned.

The present invention relates to an apparatus for transporting bobbin tubes of a textile machine.

In German Offenlegungsschrift DE 37 12 027, a transport apparatus is disclosed for transporting both tubes having yarn built thereon and empty tubes to and from a textile machine. Each tube is supported by a peg tray-type support device having a peg for insertion of the tube thereon to support the tube in an upright disposition. The peg trays are guided in a generally U-shaped guide conduit during their travel. However, the peg trays are continuously subjected to rubbing contact with the interior surfaces of the U-shaped guide conduit during guiding of the peg trays and this leads to consequent wear of the peg trays which detrimentally impairs the precision of the peg tray transport apparatus. Accordingly, the need exists for a transport apparatus for transporting tubes of a textile machine which minimizes wearing contact between the moving tube supporting components of the transport apparatus and the fixed guide components of the transport apparatus.

SUMMARY OF THE INVENTION

The present invention provides an apparatus for transporting tubes of a textile machine which minimizes wearing contact between those components of the transport apparatus which support the tubes and which move relative to other, fixed, components of the transport apparatus.

Briefly described, the present invention provides for a transport apparatus for transporting tubes, the transport apparatus includes a flexible endless member having an elongate extent transverse to its endless extent, drive means for driving said flexible endless member and a plurality of carrier portions, mounted to said flexible endless member, for supporting tubes for the transport of the tubes by said flexible endless member. Also, the transport apparatus includes fixed guide means for guiding said flexible endless member in an endless travel path on the textile machine with said elongate extent of said flexible endless member in a generally vertical orientation and a plurality of movable guide means connected to said flexible endless member at spaced intervals and movable therewith. The movable guide means are engagable with said fixed guide means for spacing said flexible endless member out of interference with said fixed guide means during movement of said flexible endless member.

In the preferred embodiment, the movable guide means includes a plurality of projecting portions connected to said flexible endless member and projecting laterally outwardly with respect to the endless extent of said flexible endless member. The projecting portions are uniformly spaced from one another relative to the endless extent of said flexible endless member. Also, the transport apparatus includes change of direction means for engaging and guiding said flexible endless member along arcuate portions of its travel path. The change of direction means are rotatably mounted to the textile machine and have a plurality of circumferentially spaced projection engaging portions. The projection engaging portions are spaced from one another in correspondence with the spacing of said projecting portions from one another relative to the endless extent of said flexible member and each projection engaging portion is operable to engage a respective one of said projecting portions for guiding movement of said flexible endless member by said change of direction means.

According to one aspect of the present invention, each projecting portion is paired with another projecting portion and each projecting portion of each respective pair of projecting portions is disposed on a respective lateral side of said flexible endless member generally opposite the other projecting portion. The projection engaging portions of said change of direction means are operable to engage one projecting portion of each respective pair of projecting portions. The movable guide means includes a plurality of interconnecting members, each interconnecting member interconnecting a respective pair of said projecting portions to one another and to said flexible endless member.

The change of direction means preferably has an outer circumference and each projecting portion engaged by said change of direction means has an arcuate surface in facing arrangement with said flexible endless member. The radius of said arcuate surface is preferably no greater than the radius of said change of direction means outer circumference.

Each projecting portion preferably includes means for gliding engagement with said fixed guide means.

According to one aspect of the present invention, the movable guide means have uniform cross sectional extents measured transversely to the endless extent and the elongate extent of said flexible endless member and said fixed guide means includes a lower portion having a generally U-shaped cross section of a lateral extent compatibly configured with respect to said uniform cross sectional extents of said movable guide means for guiding support of said movable guide means disposed in said lower portion of said fixed guide means.

According to a further aspect of the present invention the fixed guide means includes flange members extending transversely to the endless extent and the elongate extent of said flexible endless member and each said movable guide means includes horizontal support portions for gliding engagement with said flange members during movement of said flexible endless member.

In an additional aspect of the present invention, the transport apparatus is used in textile machines having a plurality of tube support trays, each for individually supporting a tube in upright disposition thereon, and each carrier portion of the transport apparatus is connected to a respective one of said movable guide means and is operable to releasably engage the tube support trays for movement of the tube support trays by said flexible endless member.

The present invention also provides a transport apparatus for transporting tubes in a textile machine of the type in which yarn is handled on tubes. The transport apparatus includes a flexible endless member and a change of direction means. The flexible endless member has a plurality of projecting portions projecting laterally outwardly with respect to the endless extent of said flexible endless member. The projecting portions are uniformly spaced from one another relative to the endless extent of said flexible endless member. The change of direction means engages and guides said flexible endless member along arcuate portions of its travel path and is rotatably mounted to the textile machine. The change of direction means has a plurality of circumferentially spaced projection engaging portions. The projection engaging portions are spaced from one another in correspondence with said spacing of said projecting portions and each projection engaging portion is operable to engage a respective one of said projecting portions during guiding movement of said flexible endless member by said change of direction means.

DETAILED DESCRIPTION OF THE PREFERRED EMBODIMENTS

Figure 1:
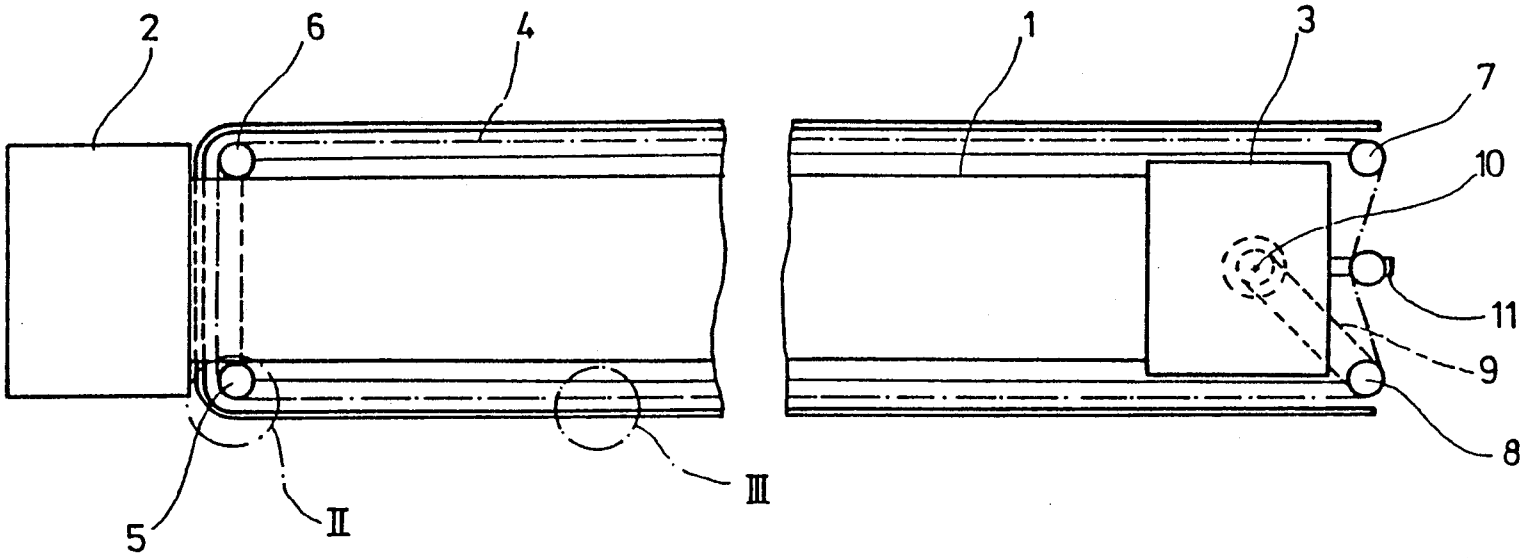
FIG. 1 is a schematic plan view of a textile machine and the preferred embodiment of the transport apparatus of the present invention operatively installed on the textile machine.

Referring to the drawings, the preferred embodiment of the transport apparatus of the present invention is illustrated in conjunction with a conventional textile machine such as, for example, a ring spinning machine 1, that includes a pair of end frames 2, 3, each end frame being disposed adjacent a respective end of the ring spinning machine, and a plurality of spinning stations (not shown) disposed between the end frames 2, 3. The spinning stations each operate in conventional manner to build yarn onto tubes into yarn packages.

The transport apparatus is provided for delivering empty tubes to the spinning stations and for transporting tubes having yarn built thereon from the spinning stations to a location for further handling. The transport apparatus includes a flexible endless member in the form of a flat metal belt 4 extending around the periphery of the spinning stations in a closed loop. The belt 4 is trained around a plurality of change of direction means 5–8 for guiding the belt 4 in changes of direction along its endless closed loop path. Each change of direction means 5, 6, 7 and 8 which can be, for example, a generally circular cog wheel, is rotatably mounted to the textile machine 1 for rotation about a vertical axis.

Figure 2:
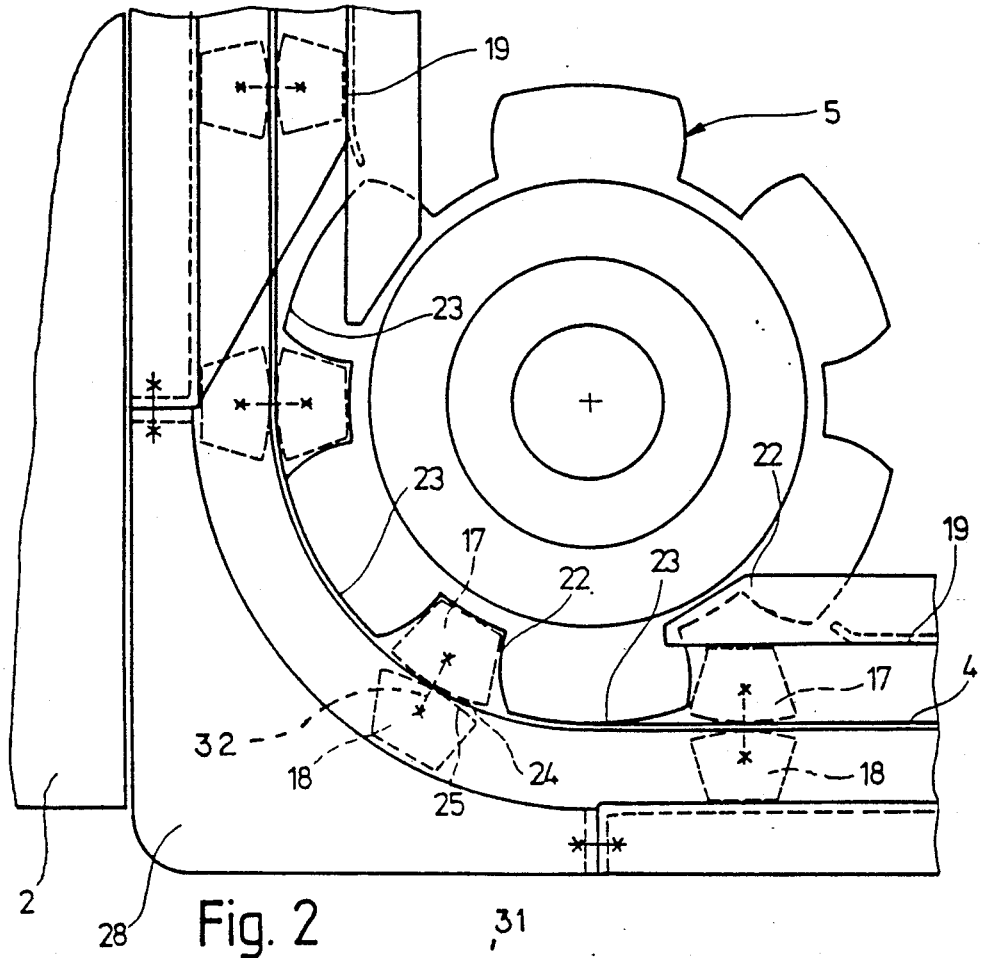
FIG. 2 is an enlarged plan view of the portion of the textile machine and the transport apparatus shown in FIG. 1 designated as II and showing a change of direction means of the transport apparatus in greater detail.
Figure 3:
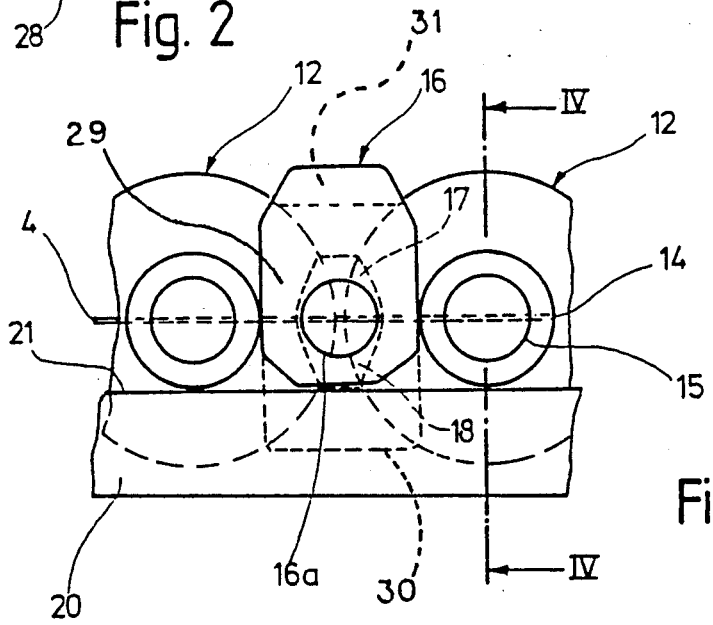
FIG. 3 is an enlarged plan view of the portion of the transport apparatus shown in FIG. 1 designated as III and showing the tube carrier portion of the transport apparatus in greater detail.
Figure 4:
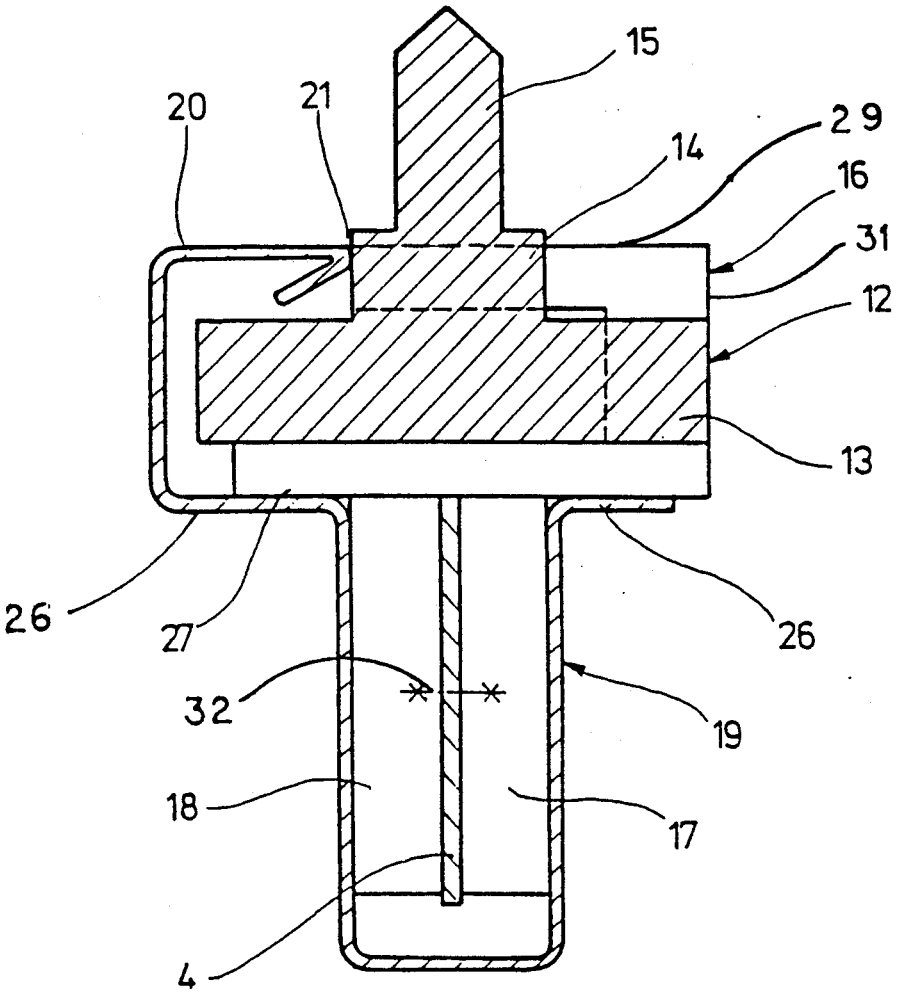
FIG. 4 is a vertical sectional view of the transport apparatus shown in FIG. 3 and taken along line IV—IV thereof.

As best seen in FIGS. 2–4, the belt 4 is flat with its flat sides forming an elongate extent transverse to its endless extent and it is supported during its travel in its endless travel path with its elongated extent or flat sides at a generally vertical orientation. To support the belt 4 in an orientation in which its elongate extent is generally vertical, the transport apparatus additionally includes a fixed guide means in the form of a channel 19 and a plurality of movable guide means connected to the belt 4 at spaced intervals and movable therewith. The fixed guide channel 19 includes, as best seen in FIG. 4, a lower portion having a generally U-shaped cross section, a pair of horizontal flanges 26 projecting laterally outwardly from the top of the sides of the U-shaped lower portions, and an upper guide shoulder portion 20 upwardly and projecting laterally inwardly from the outer end of the outer flanges 26. The upper guide shoulder portion 20 is formed with a rounded inner edge 21 which can be formed, for example, by bending of the material comprising the upper guide shoulder portion.

Each movable guide means includes a pair of laterally projecting portions or blocks 17, 18 with each of the blocks 17, 18 projecting laterally from the belt 4 in opposed disposition. As seen in FIGS. 2 and 4, the blocks of each respective pair of blocks 17, 18 are interconnected to each other and to the belt 4 by a conventional interconnecting component 32 which can be, for example, a bolt. Each projecting block 17, 18 is identically configured and, as seen in FIG. 2, includes an arcuate surface 24, 25, respectively, arranged in facing disposition to the belt 4 to accommodate arcuate flexing of the belt 4 as it changes direction in traveling around its endless path. The belt 4 is preferably formed of flexible steel, such as, for example, band steel, and the projecting portions 17, 18 are preferably formed of plastic material.

The U-shaped portion of the fixed guide channel 19 has a lateral extent compatibly configured with the cross sectional lateral extent of the blocks 17,18 for receiving the blocks therein in relatively close fitting yet freely movable disposition for guiding of the blocks 17, 18 and connected belt 4 in the endless travel path of the belt The transport apparatus additionally includes a plurality of carrier members 16 for supporting a plurality of conventional peg trays 12 and a plurality of empty tubes during transport thereof by the belt 4. Each carrier member 16 is associated with one of the pairs of guide blocks 17,18. As best seen in FIGS. 3 and 4, each carrier member 16 is formed with a generally C-shaped cross section, having a base 27 that is preferably integrally formed with the inner block 17. The base 27 of each carrier member 16 extends laterally over the lateral flanges 26 of the guide channel 19 for support thereby and for support thereon of the peg trays 12. The C-shape of the carrier members 16 is designed to cooperate with the upper guide shoulder portion 20 of the fixed guide means 19 to reliably maintain the peg trays 12 in a desired orientation during their transport by the flexible endless member 4. Specifically, each carrier member 16 is compatibly configured with respect to the base portion 13 of a peg tray 12, which comprises the largest radial portion of the peg tray, to overlap the peg tray base portion 13 and with respect to the collar portions 14 of adjacent peg trays 12 which collar portions 14 are above and of lesser radius than the base portions 13, with the carrier members 16 thereby spacing the peg trays 12 and engaging the collar portions 14 of leading peg trays to spiral the peg tray 12 along the guided path of the belt 4. The collar portions 14 of the peg trays 12 have formed thereon upwardly projecting peg portions 15 onto which tubes are inserted for support by the peg tray 12.

Each carrier member 16 includes a retaining portion 29 projecting horizontally at a vertical spacing portion 31 that extends upwardly from the base portion 27 of the carrier member 16 to space the retaining portion 29 therefrom to accommodate therebetween the base portions 13 of adjacent peg trays 12. Each retaining portion 29 is configured to extend over a portion of the base portions 13 of each of a pair of adjacent peg trays 12, as seen in FIG. 3, and has an extent as measured in the direction of the belt 4 compatibly configured with the diameter of the collar portions 14 of the peg trays 12 such that the carrier members 16 cooperate to retain the collars 14 of adjacent peg trays 12 disposed therebetween in relatively close yet releasable disposition.

The spacing portion 31 of each carrier member 16 projects upwardly from outer end of the guide block 17 that projects from the machine side of the belt 4 Each spacing portion 31 abuts the base portions 13 of the pair of adjacent peg trays 12 associated with the respective carrier member 16. As seen in FIG. 3, the spacing portion 31 of each carrier member 16 acts on the base portion 13 of the peg trays to resist lateral movement of the peg trays in a laterally outward direction with respect to the belt 4 while the upper guide shoulder portion 20 of the fixed guide means 19 contacts the collar portions 14 of the peg trays to resist lateral outward movement of the peg trays in the laterally opposite direction.

The base portions 13 of each adjacent pair of peg trays 12 are supported on the base portion 27 of the associated carrier member 16 with each peg tray 12 being supported on the base portions 30 of adjacent carrier members 16. As seen in FIG. 4, the base portion 27 of each carrier member 16 has a lateral extent with respect to the belt 4 sufficient to extend over the horizontal flanges 26. Accordingly, it can be seen that the belt 4 is horizontally and vertically supported on, yet spaced from, the guide channel 19 during its travel in an endless travel path around the spinning stations of the textile machine 1. The projecting portions 17, 18 space the belt 4 from the U-shaped lower portion of the guide channel 19 while the base portions 27 of the carrier members 16 slide along the horizontal flanges 26 of the guide channel 19 to support the belt 4 at a uniform vertical disposition during its travel. Additionally, the peg trays 12 are supported in a uniform lateral orientation relative to the belt 4 through the lateral movement limiting actions of the spacing portions 31 of the carrier members 16 and the upper guide shoulder portion 20 of the guide channel 19. Moreover, since each peg tray 12 is supported on the base portions 27 of adjacent carrier members 16, the peg trays 12 are maintained at a uniform height during their transport by the belt 4. Since the belt 4 is not in contact with the guide channel 19 during its travel, detrimental friction wear of the belt 4 is avoided.

Each carrier member 16 also includes, as seen in FIG. 3, a post portion 16A extending vertically from its vertical retaining portion 29. Each post portion 16A is configured with respect to the tubes transported by the belt 4 for snugly receiving a tube inserted thereon to support the tube during travel of the belt 4. The post portion 16A of the carrier member 16 is laterally positioned on the retaining portion 29 of the carrier member such that the post portion 16A is generally laterally centered on the belt 4—i.e., each post portion 16A is laterally aligned with the peg portions 15 of the peg trays 12 which are supported by the carrier members 16. Additionally, vertical extents of the post portions 16A of the carrier members 16 are such that the uppermost free ends of the post portions are generally at the same height as the upper ends of the peg portions 15 of the peg trays 12.

As seen in FIG. 2, the guide channel 19 includes a plurality of corner guide portions 28 for interconnecting the upper guide shoulder portions 20 of each linear portion of the guide channel 19. Each corner guide portion 28 is formed with an arcuate edge for cooperating with change of direction means 5–8. As illustratably depicted by the change of direction wheel 5 in FIG. 2, each change of direction wheel 5–8 is formed with a plurality of uniformly circumferentially spaced projection engagement portions or recesses 22 and a plurality of outer circumferential guide portions or cogs 23 which are uniformly circumferentially spaced and arranged in alternating manner with the recesses 22. Moreover, the uniform circumferential spacing of the recesses 22 corresponds to the uniform spacing of the projecting portions 17,18 of the movable guide means along the endless extent of the belt 4 such that each projecting portion 17 is received in a recess 22 during movement of the belt 4 past the respective change of direction means 5–8.

Each recess 22 extends radially inwardly with outwardly tapering arcuate side walls that are shaped to accommodate entry and discharge of the blocks 17 as the belt 4 travels in a linear path to and from the arcuate path imposed by the wheel 5. Each recess 22 is compatibly configured with the blocks 17 such that each recess 22 receives a block 17 therein in relatively close yet releasable disposition for guiding movement of the blocks by the respective change of direction wheels 5–8.

As seen in FIG. 1, the change of direction wheel 8 is configured to be driven by a conventional power source which includes a conventional power motor 10 and a conventional endless drive member 9 interconnecting the output shaft of the power motor 10 and the change of direction wheel 8 for driving rotation of the wheel and thereby, through the blocks 17, the endless belt 4. Additionally, belt tensioning assembly 11 is provided for selectively adjusting the tension of the belt 4 during its travel. The tensioning assembly 11 is operable to selectively increase or decrease the effective length of the extent of the endless member between the adjacent change of direction wheels 7 and 8 to thereby effect corresponding increases or decreases in the tension of the belt 4.

The projection engagement recesses 22 of each of the change of direction wheels 5-8 engage the projecting blocks 17 of the movable guide means to guide the belt 4 during arcuate portions of its travel in which the direction of travel of the belt is changed. As best seen in FIG. 2, each projecting block 17 is received in a respective one of the recesses 22 as the block 17 exits an adjacent linear portion of the fixed guide channel 19. The outer circumferential guide portions 23 of each change of direction wheel 5–8 laterally supports the extent of the belt 4 between the projecting blocks 17 during the arcuate travel of the belt 4. Additionally, the edge of the corner guide portions 28 cooperate with the carrier members 16 to engage the collars 14 of the peg trays 15 to thereby limit the lateral movement of each peg tray 12.

The belt-facing arcuate surfaces 24, 25 of the blocks 17, 18 each have a radius no greater than the radius of the outer surface of the circumferential guide cogs 23 of the change of direction wheels 5–8 and this geometry permits the projecting blocks 17, 18 to accommodate arcuate flexing of the belt 4 into full contact with the outer surface of the cogs 23 while minimizing undesirable, non-arcuate bending of the belt 4 during its guiding by the change of direction wheels 5–8.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type in which yarn is handled on tubes, a transport apparatus for transporting tubes, comprising:

a plurality of tube support trays, each tube support tray having an axis and being operable to support a tube in an upright disposition parallel to the tray axis and each tube support tray having a base portion and a raised portion extending upwardly from the base portion, the raised portion having a lesser cross-sectional extent as measured transversely to the tray axis than the base portion;

a flexible endless member having an elongate extent transverse to its endless extent;

drive means for driving the flexible endless member;

a plurality of carrier portions, mounted to the flexible endless member, for supporting tubes for the transport of the tubes by the flexible endless member, each carrier portion having a support component and an overhand component extending laterally beyond the support component in a lateral direction transverse to the elongate and endless extends of the flexible endless member;

fixed guide means for guiding the flexible endless member in an endless travel path on the textile machine with the elongate extent of the flexible endless member in a generally vertical orientation; and a plurality of movable guide means connected to the flexible endless member at spaced intervals and movable therewith, the movable guide means being engageable with the fixed guide means for spacing the flexible member out of interference with the fixed guide means during movement of the flexible endless member and each adjacent pair of the carrier portions being operable to retain a respective one of the tube support trays therebetween for movement of the respective tube support tray by the flexible endless member with the base portion of the respective tube support tray extending between, and being supported on, the support components of the respective adjacent pair of the carrier portions, and each of the overhand components of the adjacent pair of carrier portions extending over the base portion of the tube support tray on a respective opposite side of the raised portion thereof and being in engagement with the raised portion of the respective tube support tray.

2. In a textile machine, the transport apparatus according to claim 1 and characterized further in that said movable guide means includes a plurality of projecting portions connected to said flexible endless member and projecting laterally outwardly with respect to the endless extent of said flexible endless member, said projecting portions being uniformly spaced from one another relative to the endless extent of said flexible endless member, and characterized further by change of direction means for engaging and guiding said flexible endless member along arcuate portions of its travel path, said change of direction means being rotatably mounted to the textile machine and having a plurality of circumferentially spaced projection engaging portions, said projection engaging portions being spaced from one another in correspondence with the spacing of said projecting portions from one another relative to the endless extent of said flexible member, and each projection engaging portion being operable to engage a respective one of said projecting portions for guiding movement of said flexible endless member by said change of direction means.

3. In a textile machine, the transport apparatus according to claim 2 and characterized further in that each projecting portion is paired with another projecting portion, each projecting portion of each respective pair of projecting portions being disposed on a respective lateral side of said flexible endless member generally opposite the other projecting portion, and said projection engaging portions of said change of direction means being operable to engage one projecting portion of each respective pair of projecting portions.

4. In a textile machine, the transport apparatus according to claim 3 and characterized further in that said movable guide means includes a plurality of interconnecting members, each interconnecting member interconnecting a respective pair of said projecting portions to one another and to said flexible endless member.

5. In a textile machine, the transport apparatus according to claim 3 and characterized further in that said change of direction means has an outer circumference and each projecting portion engaged by said change of direction means has an arcuate surface in facing arrangement with said flexible endless member and the radius of said arcuate surface is no greater than the radius of said change of direction means outer circumference.

6. In a textile machine, the transport apparatus according to claim 3 and characterized further in that each said projecting portion is formed of plastic material to facilitate gliding engagement of said projecting portion with said fixed guide means.

7. In a textile machine, the transport apparatus according to claim 3 and characterized further in that said movable guide means have uniform cross sectional extents measured transversely to the endless extent and the elongate extent of said flexible endless member, said fixed guide means includes a lower portion having a generally U-shaped cross section of a lateral extent compatibly configured with respect to said uniform cross sectional extents of said movable guide means for guiding support of said movable guide means disposed in said lower portion of said fixed guide means.

8. In a textile machine, the transport apparatus according to claim 7 and characterized further in that said fixed guide means includes flange members extending transversely to the endless extent and the elongate extent of said flexible endless member and each said movable guide means includes horizontal support portions for gliding engagement with said flange members during movement of said flexible endless member.

9. In a textile machine, the transport apparatus according to claim 3 wherein the textile machine includes a plurality of tube support trays, each for individually supporting a tube in upright disposition thereon, and characterized further in that each of said carrier portions is connected to a respective one of said movable guide means and said carrier portions are operable to releasably engage the tube support trays for movement of the tube support trays by said flexible endless member.

10. In a textile machine, the transport apparatus according to claim 2 and characterized further in that said means for driving said flexible endless member includes means for rotatably driving said change of direction means.

11. In a textile machine, the transport apparatus according to claim 1 and characterized further by means for adjusting the tension of said flexible endless member.

* * * * *